US012392094B2

(12) United States Patent
Aldahir et al.

(10) Patent No.: US 12,392,094 B2
(45) Date of Patent: Aug. 19, 2025

(54) ARTIFICIAL TURF AND METHODS OF MAKING SAME

(71) Applicant: Columbia Insurance Company, Omaha, NE (US)

(72) Inventors: Philipe Aldahir, Chattanooga, TN (US); Derek Bass, Cartersville, GA (US); Jim Burns, Rocky Face, GA (US)

(73) Assignee: Columbia Insurance Company, Omaha, NE (US)

( * ) Notice: Subject to any disclaimer, the term of this patent is extended or adjusted under 35 U.S.C. 154(b) by 873 days.

(21) Appl. No.: 16/553,973

(22) Filed: Aug. 28, 2019

(65) Prior Publication Data

US 2020/0071886 A1 Mar. 5, 2020

Related U.S. Application Data

(60) Provisional application No. 62/723,650, filed on Aug. 28, 2018.

(51) Int. Cl.

| | |
|---|---|
| ***E01C 13/08*** | (2006.01) |
| ***A41G 1/00*** | (2006.01) |
| ***D04H 11/08*** | (2006.01) |
| ***D05C 17/02*** | (2006.01) |
| ***D06N 7/00*** | (2006.01) |

(52) U.S. Cl.

CPC ..... *E01C 13/08* (2013.01); *D04H 11/08* (2013.01); *D05C 17/023* (2013.01); *D06N 7/0068* (2013.01); *D10B 2505/202* (2013.01); *Y10T 428/23979* (2015.04)

(58) Field of Classification Search

CPC .... E01C 13/08; D05C 17/023; D06N 7/0068; D10B 2505/202; Y10T 428/23979; D04H 11/08

See application file for complete search history.

(56) References Cited

U.S. PATENT DOCUMENTS

| | | | |
|---|---|---|---|
| 3,565,742 | A | 2/1971 | Stephens et al. |
| 3,617,413 | A | 11/1971 | Elbert |
| 3,740,303 | A | 6/1973 | Alderson et al. |

(Continued)

FOREIGN PATENT DOCUMENTS

| | | | |
|---|---|---|---|
| CN | 103603253 | A | 2/2014 |
| CN | 204343135 | U | 5/2015 |

(Continued)

OTHER PUBLICATIONS

English translation obtained from PE2E database of DE 195 06 845 A1 to Anklam (Year: 1996).*

(Continued)

*Primary Examiner* — Jeremy R Pierce

(74) *Attorney, Agent, or Firm* — Ballard Spahr LLP

(57) ABSTRACT

Disclosed are artificial turfs having a nonwoven backing layer and a plurality of turf fibers extending through the nonwoven backing layer such that a face side portion of the turf fibers extends from the face side of the nonwoven backing layer and a back side portion of the turf fibers extends from the back side of the nonwoven backing layer, wherein at least a portion of the back side portion of turf fibers are bonded to themselves. Also disclosed herein are the methods of making the same.

18 Claims, 9 Drawing Sheets

(56) References Cited

U.S. PATENT DOCUMENTS

| | | | | | |
|---|---|---|---|---|---|
| 4,107,361 | A | | 8/1978 | Parker | |
| 4,439,476 | A | * | 3/1984 | Guild | D05C 17/02 156/254 |
| 4,443,575 | A | * | 4/1984 | Iwai | D06N 7/0076 428/95 |
| 4,705,706 | A | | 11/1987 | Avery | |
| 5,474,829 | A | * | 12/1995 | Woosley | D03D 27/00 428/95 |
| 5,536,551 | A | * | 7/1996 | Woosley | B32B 5/26 428/95 |
| 5,556,684 | A | * | 9/1996 | Forero | B32B 5/02 428/95 |
| 6,723,413 | B2 | | 4/2004 | Walters | |
| 6,818,274 | B1 | | 11/2004 | Buck et al. | |
| 6,849,565 | B1 | * | 2/2005 | Gardner | D06N 7/0065 428/95 |
| 7,166,340 | B1 | | 1/2007 | Clark | |
| 7,585,555 | B2 | | 9/2009 | Stroppiana | |
| 7,670,661 | B2 | | 3/2010 | Stroppiana | |
| 7,740,420 | B2 | | 6/2010 | Jones et al. | |
| 7,758,281 | B2 | | 7/2010 | Knox | |
| 7,939,144 | B2 | | 5/2011 | Verleyen | |
| 8,153,227 | B2 | | 4/2012 | Stroppiana | |
| 8,403,597 | B2 | | 3/2013 | Ayers et al. | |
| 9,309,630 | B2 | | 4/2016 | Allingham et al. | |
| 9,587,367 | B2 | | 3/2017 | Ayers et al. | |
| 2004/0077242 | A1 | | 4/2004 | Layman | |
| 2005/0075025 | A1 | * | 4/2005 | Ueda | B32B 7/12 428/85 |
| 2005/0147787 | A1 | * | 7/2005 | Bailey | B32B 27/28 442/268 |
| 2008/0017294 | A1 | * | 1/2008 | Bailey | D03D 15/283 156/72 |
| 2008/0044599 | A1 | * | 2/2008 | Stroppiana | E01C 13/08 428/17 |
| 2009/0041956 | A1 | | 2/2009 | Gilman et al. | |
| 2009/0152191 | A1 | * | 6/2009 | Dijkema | D04H 1/542 428/95 |
| 2011/0020567 | A1 | | 1/2011 | Avery | |
| 2012/0107526 | A1 | | 5/2012 | Lee | |
| 2012/0244310 | A1 | * | 9/2012 | Visscher | B32B 5/022 428/95 |
| 2014/0250780 | A1 | | 9/2014 | Lee et al. | |
| 2015/0167254 | A1 | | 6/2015 | Verleyen et al. | |
| 2015/0376844 | A1 | | 12/2015 | Palau Gea et al. | |
| 2016/0265170 | A1 | | 9/2016 | Vachon et al. | |
| 2017/0314191 | A1 | * | 11/2017 | Visscher | B32B 5/024 |
| 2017/0362743 | A1 | | 12/2017 | De Keyzer et al. | |
| 2020/0332478 | A1 | * | 10/2020 | Hwang | B32B 7/027 |

FOREIGN PATENT DOCUMENTS

| | | | | | |
|---|---|---|---|---|---|
| CN | 204551181 | U | | 8/2015 | |
| DE | 19506845 | A1 | * | 8/1996 | D06N 7/0068 |
| EP | 1705292 | A1 | * | 9/2006 | D05C 17/02 |
| EP | 2883988 | B1 | | 4/2016 | |
| EP | 3029198 | A1 | | 6/2016 | |
| EP | 3080346 | B1 | * | 5/2019 | E01C 13/08 |
| FR | 2515227 | A1 | | 4/1983 | |
| JP | H09242011 | A | | 9/1997 | |
| KR | 20110135132 | A | | 12/2011 | |
| WO | WO-9400639 | A1 | | 1/1994 | |
| WO | WO-0137657 | A1 | * | 5/2001 | B32B 5/26 |
| WO | WO-2017046648 | A1 | | 3/2017 | |
| WO | WO-2017157911 | A1 | | 9/2017 | |

OTHER PUBLICATIONS

Steinbach, Paul, "Synthetic Turf Fields Benefitting from Latest Fiber Technology," Athletic Business, athleticbusiness.com, Feb. 2011. [https://www.athleticbusiness.com/Outdoor/synthetic-turf-fields-benefitting-fromlatest-fiber-technology.html].

"XtraGrass: the Ideal Solution," Xtra Grass ™, xtragrass-hybrid-turf.com, Mar. 19, 2015. [https://web.archive.org/web/20150319001501/http://www.xtragrass-hybridturf.com:80/xtragrass/].

"Permeable and Recyclable; a New Generation of Artificial Grass," CCGrass,ccgrass.com, Mar. 29, 2017. [https://www.ccgrass.com/permeable-and-recyclable-a-new-generation-of-artificialgrass/].

"Benefits of XGRass Synthetic Turf," XGRass, tourgreennashville.com, Oct. 6, 2016. [https://web.archive.org/web/20161006052538/http://www.tourgreensnashville.com:80/xgrass-artificial-grass-benefits.html].

"CLOSURETURF": Product Overview, AGRU, arguamerica.com, Jun. 6, 2017. [https://web.archive.org/web/20170606153453/https://agruamerica.com/products/closureturf/].

"5-100SQM Synthetic Grass Artificial Turf Plastic Green Plant Lawn Flooring Green," eBay, ebay.com, brand: Prime Turf, seller: ozplaza.living, eBay item No. 391951283473, UPC: 9350062143360, Feb. 6, 2018.[https://web.archive.org/web/20180206232303/https://www.ebay.com.au/itm/5--100SQM-Synthetic-Grass-Artificial-Turf-Plastic-Green-Plant-Lawn-FlooringGreen-/391951283473].

"Green Artificial Grass," Forever Lawn®, foreverlawn.com, Feb. 6, 2018. [https://web.archive.org/web/20180206235145/http://www.foreverlawn.com/green/].

'Nonwoven Fabric', Wikipedia, 2015, para 1, section 2.7, [retrieved from the internet Jan. 9, 2020 at <https://en.wikipedia.org/wiki/Nonwoven_fabric>].

'Batt', Lexico, definition of batt in english, [retrieved from the internet Jan. 9, 2020 at <https://www.lexico.com/en/definition/batt>].

Airlay Technology', Nonwovens Industry, pare 1, [retrieved from the Internet Jan. 9, 2020 at <https://www.nonwovens-industry.com/contents/view_breaking-news/0000-00-00/airlay-technology/>].

International Search Report and Written Opinion were mailed on Feb. 5, 2020 by the International Searching Authority for International Application No. PCT/IB2019/001063, filed on Aug. 28, 2019 and published as WO 2020/084339 on Apr. 30, 2020 (Applicant-Philippe Aldahir) (27 Pages).

* cited by examiner

ARTIFICIAL TURF AND METHODS OF MAKING SAME

CROSS REFERENCE TO RELATED APPLICATIONS

This application claims the benefit of priority to co-pending U.S. patent application Ser. No. 62/723,650 filed Aug. 28, 2018. The entire disclosure of the aforementioned patent application is incorporated by reference herein.

TECHNICAL FIELD

The present invention relates generally to novel artificial turf products and the methods of making the same. Broadly, the present disclosure relates to artificial turf structures having turf performance attributes built-in. More specifically, the current disclosure is directed to methods of replacing conventional woven fabrics used as primary backings for structures comprising non-woven substrates or three-dimensional (3D) substrates that support the grass fibers in an upright position, provide proper footing and impact attenuation, and drainage, potentially even eliminating the need for constructing a drainage sub-base below the artificial turf. The present invention also relates to the artificial turf products that comprise gravitationally laid staple fibers into a nonwoven substrate.

BACKGROUND

Artificial turf surfaces became increasingly popular as a replacement for natural grass in stadiums, on golf courses, playground areas and sports playing fields. Artificial turfs are also widely used in the areas where natural grass is hard or impossible to grow but from physical or esthetic purposes is desired to have. For example, the artificial grass can be placed as a landscaping turf in low traffic areas between runways and highways to eliminate maintenance and discourage wildlife, or in places where additional erosion control is required. Artificial turf surfaces require less maintenance than grass surfaces and do not require water, chemicals or sunlight for satisfactory performance and sustainability. The environmental impact of artificial turf surfaces is considered less than that of an equivalent grass surface, not least because of reduced water and maintenance requirements. The versatility of the synthetic turf allows it to be placed in totally dry regions, regions of high rainfall, extreme heat conditions, and cold regions. It requires no sunlight and can be laid indoors. It can even be made to be portable; laid and removed as and when needed for use.

However, currently available artificial turfs act only as a fabric for aesthetic reasons. The performance of the turf system, such as drainage, footing, and impact attenuation, comes from components below the fabric (shock pad, drainage sub-base, geotextile fabrics), or above the artificial turf carpet (particulate infill). Thus, there is still a need for an artificial turf structure that provides all the mentioned above performance parameters in itself.

Also due to the increasing popularity of artificial turfs, the better and more economically beneficial artificial turfs are needed. There is a need for a novel artificial turf product that is 100% recyclable in accordance with "cradle to cradle design," that utilizes nonwoven substrates, and in some aspects, even allows the elimination of the primary woven backing. There is also a need for an artificial turf product having a non-woven substrate that results in a cushioned structure.

SUMMARY

The present disclosure is directed to an artificial turf, comprising: a nonwoven backing layer having a face side and a back side, and a plurality of turf fibers extending through the nonwoven backing layer such that a face side portion of the turf fibers extends from the face side of the nonwoven backing layer and a back side portion of the turf fibers extends from the back side of the backing layer, wherein at least a portion of the back side portion of turf fibers are bonded to themselves.

In further aspects, disclosed herein is a method for manufacturing an artificial turf, comprising: inserting a plurality of turf fibers into a nonwoven backing layer having a face side and a back side such that the plurality of turf fibers extend through the nonwoven backing layer and a face side portion of the turf fibers extends from the face side of the nonwoven backing layer and a back side portion of the turf fibers extends from the back side of the backing layer; and bonding at least a portion of the back side portion of turf fibers to themselves.

Additional aspects of the invention will be set forth, in part, in the detailed description, figures, and claims, which follow, and in part will be derived from the detailed description, or can be learned by practice of the invention. It is to be understood that both the foregoing general description and the following detailed description are exemplary and explanatory only and are not restrictive of the invention as disclosed.

DETAILED DESCRIPTION

Figure 1:
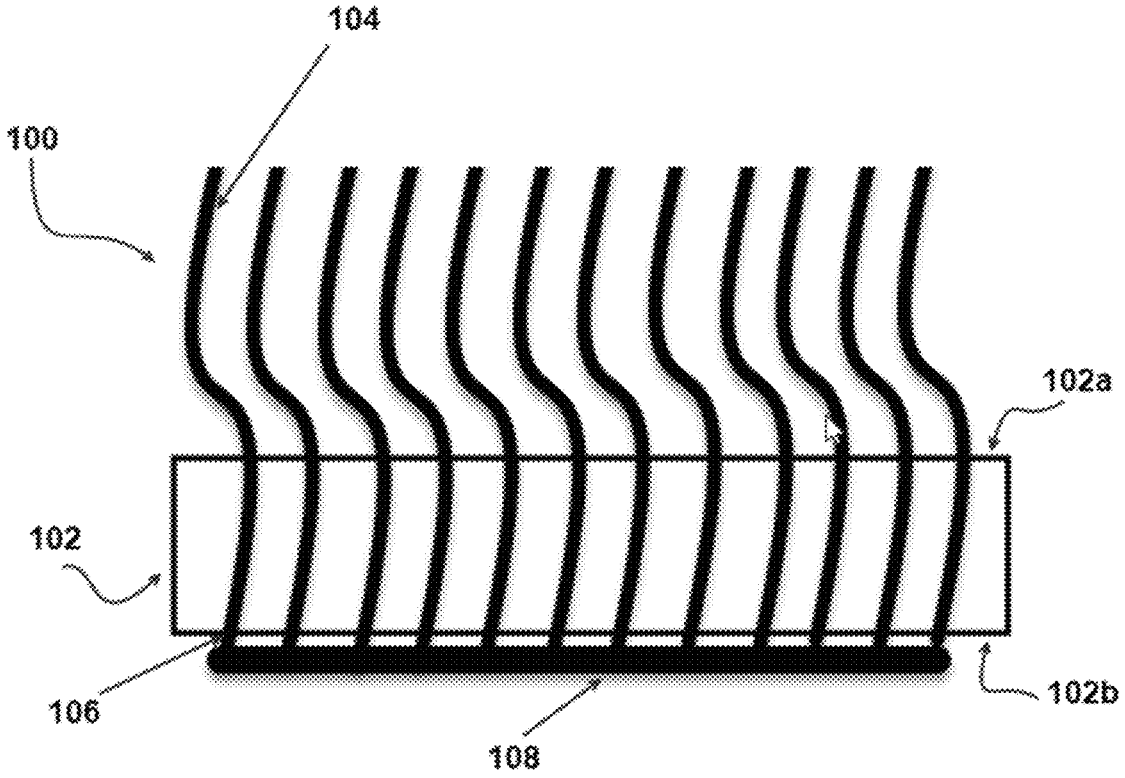
FIG. 1 depicts a schematics of an exemplary artificial turf according to aspects of the present invention.

The present invention can be understood more readily by reference to the following detailed description, examples, drawings, and claims, and their previous and following description. However, before the present articles, systems, and/or methods are disclosed and described, it is to be understood that this invention is not limited to the specific or exemplary aspects of articles, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Definitions

In this specification and in the claims that follow, reference will be made to a number of terms, which shall be defined to have the following meanings:

Throughout the description and claims of this specification the word "comprise" and other forms of the word, such as "comprising" and "comprises," means including but not limited to, and is not intended to exclude, for example, other additives, components, integers, or steps. Furthermore, it is to be understood that the terms comprise, comprising and comprises as they related to various aspects, elements and features of the disclosed invention also include the more limited aspects of "consisting essentially of" and "consisting of."

As used herein, the singular forms "a," "an" and "the" include plural referents unless the context clearly dictates otherwise. Thus, for example, reference to a "fiber batt" includes aspects having two or more such fiber batts unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It should be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

References in the specification and concluding claims to parts by weight of a particular element or component in a composition or article, denotes the weight relationship between the element or component and any other elements or components in the composition or article for which a part by weight is expressed. Thus, in a composition or a selected portion of a composition containing 2 parts by weight of component X and 5 parts by weight component Y, X and Y are present at a weight ratio of 2:5, and are present in such ratio regardless of whether additional components are contained in the composition.

A weight percent of a component, unless specifically stated to the contrary, is based on the total weight of the formulation or composition in which the component is included.

As used herein, and unless the context clearly indicates otherwise, the term "carpet" is used to generically include broadloom carpet, carpet tiles, area rugs, and artificial grass (or turf). To that end, the term "broadloom carpet" refers to a broadloom textile flooring product manufactured for and intended to be used in roll form. The term "carpet tile" refers to a modular floor covering, conventionally manufactured in 18"×18,"24"×24" or 36"–36" squares, but other sizes and shapes are also within the scope of the present invention. The artificial turf product as described herein can be manufactured in the form of a roll good or alternatively can be a modular turf panel, conventionally manufactured in 12-15 ft. by any length from 20 ft. to 200 ft., but other sizes and shapes are also within the scope of the present invention or to a roll form turf.

As used herein, "reclaimed carpet material" refers generally to any material obtained from a prior manufactured carpet product. The prior manufactured carpet product can be a post-consumer product, such as, for example, a post residential, a post commercial, a post- industrial carpet, or a reclaimed artificial grass. In aspects where the reclaimed carpet material comprises an artificial grass, the reclaimed artificial grass can be collected from any field, from, for example, an indoor, an outdoor, or a gym, after any amount of use. As used herein, "reclaimed synthetic turf material" refers generally to any material obtained from a prior manufactured synthetic turf product. The prior manufactured synthetic turf product can be a post use or post-consumer product recovered from a point of original installation. Alternatively, the reclaimed carpet material can be a pre-consumer product, such as manufacturing remnants or quality control failures. In the aspects where the reclaimed carpet material is the reclaimed artificial grass, the artificial grass can be also a pre-consumer product.

The term "fiber" as used herein includes fibers of extreme or indefinite length (i.e. filaments) and fibers of short length (i.e., staple fibers). As used herein, the term "reclaimed fiber" include a fiber reclaimed from a new product, a pre-consumer product, a post-industrial product, or a post-consumer product. In some exemplary aspect and as described above, such products comprise carpets, carpet tiles or artificial turfs.

As used herein, the term "polyester" refers to a category of polymers that contain the ester functional group in their main chain. Polyesters disclosed herein include naturally occurring chemicals, such as in the cutin of plant cuticles, as well as synthetics produced through step-growth polymerization. A non-limiting example of polyesters includes any long-chain synthetic polymer composed of at least 85% by weight of an ester of a substituted aromatic dicarboxylic acid, including but not restricted to substituted terephthalic units, $p(—R—O—CO—C_6H_4—CO—O—)_x$ and para-substituted hydroxy-benzoate units, $p(—R—O—CO—C_6H_4—O—)_x$. In certain examples, the polyesters comprise polyethylene terephthalate (PET) homopolymer and copolymers, polypropylene terephthalate (PPT) homopolymer and copolymers, polytrimethylene terephthalate homopolymer and copolymers, and polybutylene terephthalate (PBT) homopolymer and copolymers, and the like, including those that contain comonomers such as cyclohexanedimethanol, cyclohexanedicarboxylic acid, isophthalic acid, and the like.

The terms "polyamide" as utilized herein, is defined to be any long-chain polymer in which the linking functional groups are amide (—CO—NH—) linkages. The term polyamide is further defined to include copolymers, terpolymers and the like, as well as homopolymers; it also includes blends of two or more polyamides. In some aspects, the plurality of polyamide fibers comprise one or more of nylon 6, nylon 66, nylon 10, nylon 612, nylon 12, nylon 11, or any combination thereof. In other aspects, the plurality of polyamide fibers comprises nylon 6 or nylon 66. In yet another aspect, the plurality of polyamide fibers is nylon 6. In a yet further aspect, the plurality of polyamide fibers is nylon 66.

As defined herein, the term "polyolefin" refers to any class of polymers produced from a simple olefin (also called an alkene with the general formula $C_nH_{2n}$) as a monomer. In some aspects, the polyolefins include, but are not limited to, polyethylene, polypropylene, both homopolymer and copolymers, poly(I-butene), poly(3-methyl-I-butene), poly(4-methyl-1-pentene) and the like, as well as combinations or mixtures of two or more of the foregoing.

As defined herein, the term "polyurethane" refers to any class of polymers composed of a chain of organic units joined by carbamate (urethane, $R_1$—O—CO—$NR_2$—$R_3$, wherein R1, R2 and R3 are the same or different) links.

As defined herein, the term "polystyrene" refers to any class of synthetic polymers produced from a simple styrene as a monomer. It is understood that the term "polystyrene" includes both atactic and syndiotactic polystyrenes. In some specific aspects, described are also co-polystyrenes including a high-impact polystyrenes (HIPS), acrylonitrile butadiene styrene (ABS) or copolymer of styrene with acrylonitrile (SAN), or copolymer of styrene with maleic acid (SMA).

As used herein, the term "nonwoven material" refers to materials made from staple fibers and/or long fibers, bonded together by any means known in the art. In some exemplary aspects, the fibers of nonwoven materials can be bonded by chemical treatment, mechanical treatment, heat treatment, or solvent treatment. In other exemplary aspects, the nonwoven materials can be densified or reinforced.

As used herein, the term "woven material" refers to any material formed by weaving. Warp and weft are terms for the two basic components used in weaving to turn thread or yarn into fabric. The lengthwise or longitudinal warp yarns are held stationary in tension on a frame or loom while the transverse weft (sometimes woof) is drawn through and inserted over-and-under the warp.

As used herein, the term "needlepunching" generally refers to a nonwoven process by which the fibers are mechanically entangled to produce a nonwoven fabric by repeated penetration of barbed needles through a preformed fibrous web, resulting in mechanically interlocked fibers.

Artificial Turf

In certain aspects, disclosed herein are various backing layers that can be used to replace conventional woven fabrics. In certain aspects, these conventional woven fabrics that commonly used as a primary backing are replaced for 3D structures that can support the grass fibers in an upright position. In certain aspects, the backing layers, described herein, can provide proper footing and impact attenuation, drainage, and potentially even eliminate the need for constructing a drainage sub-base below the artificial turf. In certain aspects, such layers can comprise a nonwoven batt, a spaghetti-mat type structure, open cell foams, wiry rigid structures, etc. Some exemplary backing layers are shown in FIGS. 2-3, and FIGS. 5-11.

FIG. 1 shows an exemplary artificial turf (100), comprising: a nonwoven backing layer (102) having a face side (102*a*) and a back side (102*b*), and a plurality of turf fibers extending through the nonwoven backing layer such that a face side portion of the turf fibers (104) extends from the face side of the nonwoven backing layer and a back side portion of the turf fibers (106) extends from the back side of the nonwoven backing layer, wherein at least a portion of the back side portion of turf fibers are bonded to themselves (108).

In certain aspects, the nonwoven backing layer comprises a fiber batt. In certain aspects, the fiber batt can be formed from gravitationally laid fibers. In still further aspects, the fiber batt comprises fibers that are mechanically bonded. In yet other aspects, the fiber batt comprises fibers that are thermally bonded. In certain aspects, the batt can be formed by gravitationally laying the fibers and mechanically interlocking the fibers. In still further aspects, the batt is semi-permeable. In still further aspects, the batt is impermeable. In certain aspects, the nonwoven backing layer is needlepunched.

In yet other aspects, the nonwoven backing layer can be further compressed to achieve a predetermined strength, density, and resilience. It is understood that one of ordinary skill in the art would determine a specific strength, density, and resilience of the nonwoven backing layer depending on the desired application. In certain exemplary aspects, the fabric strength of 150 lbs in each direction (warp/weft) can be required to produce a turf useful in sports applications. It is understood that in other applications, such as, for example, a landscape or civil engineering turf, the fabric strength can be less than 150 lbs. In yet other exemplary aspects, for example, the turf used as a roof membrane, the fabric strength can be of about 90 lbs (as tested in a wind test).

In still further aspects, the nonwoven backing layer is substantially homogeneous. In still further aspects, the nonwoven backing layer is homogenous. In still further aspects, the nonwoven backing layer is substantially uniform. In some aspects, the backing layer is heterogeneous. In still further aspects, the backing structure can be layered. In some aspects, the backing layer comprises one or more layers. In still further aspects, each of the layers can comprise the same or a different material. In still further aspects, each of the layers can have the same or a different density. In still further aspects, the backing layers can be porous.

In still further aspects, the nonwoven backing layer can comprise one or more fiber batt layers. In still further aspects, if more than one fiber batt is present, each of the present fiber batts can have the same or a different thickness. In yet other aspects, if more than one fiber batt is present, each of the present batts can have the same or a different density. In still further aspects, if more than one fiber batt is present in the nonwoven backing layer, the fiber batts can differ from each other by a various set of characteristics. For example and without limitations, characteristics that can differ between the different fiber batts include one or more of: mass per unit area, a type of fiber, a fiber length, a fiber cross-sectional size, a fiber cross-sectional shape, a fiber tenacity, a fiber crimp, proportions of fibers of different polymer types, a fiber composition (including, but is not limited to, the polymer fiber vs natural fiber, a specific polymer type used in the composition, types and amounts of additives that can be optionally included in the composition to provide desirable characteristics), resistance to ultraviolet radiation, color, resilience (meaning springiness), a sheet orientation (e.g. a top-up or a bottom-up, where the top and bottom refer to the sides of the sheets when manufactured in a substantially horizontal configuration), a sheet thickness, a degree of entanglement of the polymer fibers and the like. In certain aspects, where more than one fiber batt is present in the nonwoven backing layer, the fibers batts can be mutually attached. In certain aspects, the fiber batts present in the nonwoven backing layer can be mutually attached by the entanglement of fibers of the different batts. In yet other aspects, the fiber batts present in the nonwoven backing layer can be mutually attached by the entanglement of fibers of the different batts using a needlepunch technology or any technology similar to that. In still further aspects, the fiber batts present in the nonwoven backing layer can be mutually attached by the entanglement of fibers of the different fiber batts using a hydro-entanglement technology or any technology similar to that. In still further aspects, the fiber batts present in the nonwoven backing layer can be mutually attached by the entanglement of fibers of the different batts using an air-laid technology or any technology similar to that. In yet other aspects, the fiber batts present in the nonwoven backing layer can be mutually attached by the entanglement of fibers of the different batts using a spun-bonded technology or any technology similar to that. In yet other aspects, the fiber batts present in the nonwoven backing layer can be mutually attached by a process that includes heating. In still other aspects, the fiber batts present in the nonwoven backing layer can be mutually attached by a process that includes an application of pressure. In other aspects, the fiber batts present in the nonwoven backing layer can be mutually attached by a process that includes calendering.

In some aspects, the nonwoven backing layer does not comprise any additional binders or adhesives that are used to lock the fibers in the fiber batt. In such aspects, the terms "additional binders or adhesives" denote binders or adhesives which are not part of, or inherent in, the fibers of the fiber batt. In yet other aspects, the arrangement and contact of the fibers can lock the fibers in a specific position by mechanisms comprising a physical entangling of the fibers, friction between the fibers and/or an inherent bonding of fibers. In such aspects, the term "inherent bonding of fibers" denotes bonding, which relies upon the properties of the fibers, rather than on an additional bonding or a presence of binding materials. For example, and without limitation, the adhesion between fibers can be regarded as being an inherent bonding if they adhere due to a heat (and/or pressure) treatment, which allows them to adhere together due to the properties of the fibers; but it should not be regarded as being bonded by inherent bonding of the fibers if they are adhered by a resin or other bonding materials, which are not part of the fibers. It should be regarded that contact between fibers is intended to include contact at regions where fibers are fused or welded together, so that fused or welded (but still distinguishable) fibers are considered to have contact therebetween.

In certain aspects, the fiber batt can be formed by utilizing a card and cross lapping system, an airlay system, or a combination thereof. In still further aspects, the fiber batt can be formed by calendering. It is understood that in some aspects, after the fibers are gravitationally laid, the formed fiber batt can further be needlepunched. In still further aspects, the formed fiber batt can further be heat and pressure treated to further densify the batt.

In yet other aspects, the nonwoven backing layer can comprise any known in the art fibers. In certain aspects, the fibers are polymeric fibers. In yet other aspects, the fibers are natural fibers. In still other aspects, the fibers are biodegradable fibers. In yet certain aspects, the fibers are degradable fibers. In still further aspects, the fibers can comprise polyester fibers, polyolefin fibers, polyamide fibers, polyurethane fibers, acrylic fibers, or any other fibers known in the art. In some aspects, the nonwoven backing material is comprised of the fibers comprising at least one of nylon, polyester, polyethylene, and polypropylene, cotton, Kenaf, jute, or any combination thereof.

In aspects, where the fiber comprises nylon, it is understood that the conventional nylon fibers, for example, and without limitation, comprise one or more of nylon 6/6 fibers, nylon 6 fibers, nylon 10 fibers, nylon 10/10 fibers, nylon 10/11 fibers, or nylon 11 fibers, and the like. In aspects, where the fiber comprises polyester, it is understood that the conventional polyester fiber, for example, and without limitation, comprises one or more of polyethylene terephthalate (PET) fiber, polypropylene terephthalate (PPT) fiber, polybutylene terephthalate (PBT) fiber, or polytrimethylene terephthalate (PTT) fiber.

In still further aspects, the nonwoven backing layer can comprise various blends of fibers. In some aspects, the fibers present in the nonwoven backing layer can have the same or a different melting point. In certain aspects, the nonwoven backing layer can comprise low-melt fibers and high-melt fibers. It is understood that as used herein, the low-melt fibers define fibers having a melting point between about 100° C. and about 180° C. In certain aspects, the melting point of the low-melt fiber is about 110° C., about 120° C., about 130° C., about 140° C., about 150° C., about 160° C., or about 170° C.

In yet other aspects, the low-melt fiber can comprise, for example, and without limitation, a low-melt polyester, polypropylene, polyethylene, co-polyester, copolymer nylons, engineered olefins, conjugate filament-linear low-density polyethylene, acrylics, low-melt nylon, and the like. As one of ordinary skill in the pertinent art will appreciate, if the nonwoven backing layer is heated to thermally bond the fibers, the heating of the low-melt fiber in the disclosed nonwoven backing layer can create globules of the low-melt polymer at the crossover points where the fibers intersect.

In yet other aspects, the low-melt fibers present in the nonwoven backing layer can comprise a bi-component fiber having a portion of a high- or a standard-melt material and a portion of a low-melt polymer. In such aspects, the bi-component fiber configuration can be, for example, and without limitation, islands-in-the-sea, side-by-side, core-sheath, and the like. As one of ordinary skill in the pertinent art will appreciate, the bi-component fibers can maintain their original structural integrity while also allowing each fiber to glue itself to the adjacent fibers. It is contemplated that any known materials having appropriate melt characteristics can be used to form the bi-component fibers.

It is further understood that both the virgin and the post-consumer or the post-industrial fibers can be used. In aspects, where the post-consumer or post-industrial fibers are used, the fibers can be obtained from any textiles known in the art. In certain aspects, the fibers are obtained from the post-consumer or post-industrial carpets, carpet tiles, or artificial turfs. According to aspects of this invention, the fibers can be obtained from the various components of the prior manufactured carpet product, for example and without limitation, it can be obtained from a face layer, an adhesive layer, a backing layer, a secondary backing layer, an underlayment, a cushioning material, a reinforcing layer, or a scrim, or any combination thereof. In still further aspects, the fiber used in the inventive nonwoven backing can comprise a mixture of the virgin and recycled fibers. In some aspects, the recycled fibers can be present in any amount from 0 wt % to 100 wt %, including exemplary values of about 1 wt %, about 5 wt %, about 10 wt %, about 20 wt %, about 30 wt %, about 40 wt %, about 50 wt %, about 60 wt %, about 70 wt %, about 80 wt %, and about 90 wt %. It is further understood that any of the mentioned materials can undergo multiple recycling cycles prior to the use in the disclosed nonwoven backing layers.

In still further aspects, the fibers of the inventive fiber batt can comprise any type of fibers. In some aspects, the fibers are tape fibers. In still further aspects, the fibers are slit film fibers. In yet other aspects, the fibers are spun fibers. In still further aspects, the fiber batt can comprise air entangled yarns.

According to certain aspects, the fibers present in the nonwoven backing layer can exhibit a substantially uniform size, including a substantially uniform linear density measured in denier units and substantially uniform fiber lengths. However, in alternative aspects, the fibers present in the nonwoven backing layer can have non-uniform linear densities and non-uniform fiber lengths. In certain aspects, the nonwoven backing layer is comprised of the fibers having a length from about 1 to about 8 inches, including exemplary values of about 1.2 inches, about 1.5 inches, about 1.8 inches, about 2 inches, about 2.2 inches, about 2.5 inches, about 2.8 inches, about 3 inches, about 3.2 inches, about 3.5 inches, about 3.8 inches, about 4.0 inches, about 4.2 inches, about 4.5 inches, about 4.8 inches, about 5 inches, about 5.2 inches, about 5.5 inches, about 5.8 inches, about 6 inches, about 6.2 inches, about 6.5 inches, about 6.8 inches, about 7 inches, about 7.2 inches, about 7.5 inches, and about 7.8 inches. In still further aspects, the fiber lengths can have any value between any two foregoing length values.

As can be understood by one of ordinary skill in the art and as discussed herein, the backing layers of the current invention can also comprise various meshes, foams, elastic structures, and the like. In such aspects, the fibers can comprise plastic materials or metal materials. In certain aspects, the backing layers can also comprise wires.

In still further aspects, wherein the backing layer is the nonwoven backing layer, this nonwoven backing layer can be comprised of the fibers having a denier ranging between about 2 to less than about 20,000 denier per filament (DPF), including exemplary values of about 10 DPF, about 50 DPF, about 100 DPF, about 200 DPF, about 500 DPF, about 800 DPF, about 1,000 DPF, about 1,500 DPF, about 2,000 DPF, about 2,500 DPF, about 3,000 DPF, about 3,500 DPF, about 4,000 DPF, about 4,500 DPF, about 5,000 DPF, about 5,500 DPF, about 6,000 DPF, about 6,500 DPF, about 7,000 DPF, about 7,500 DPF, about 8,000 DPF, about 8,500 DPF, about 9,000 DPF, about 9,500 DPF, about 10,000 DPF, about 10,500 DPF, about 11,000 DPF, about 11,500 DPF, about 12,000 DPF, about 12,500 DPF, about 13,000 DPF, about 13,500 DPF, about 14,000 DPF, about 14,500 DPF, about 15,000 DPF, about 15,500 DPF, about 16,000 DPF, about 16,500 DPF, about 17,000 DPF, about 17,500 DPF, about 18,000 DPF, about 18,500 DPF, about 19,000 DPF, about 19,500 DPF, and less than 20,000 DPF. In still further aspects, the fibers can have any denier value between any two foregoing denier values.

In still further aspects, the nonwoven backing layer is comprised of the polymeric fibers having a length from about 1 to about 4 inches and a denier ranging between about 2 DPF to less than about 20,000 DPF. In still any further aspects, the nonwoven backing layer is comprised of the fibers having a length from about 1 to about 4 inches and a denier ranging between about 2 to about 1,000 DPF.

In still further aspects, the nonwoven backing can further comprise at least one additive material distributed therein. In certain aspects, the at least one additive material comprises at least one of rubber crumbs, wood chips, sand, grass seeds, foam chips, and an inorganic filler. In certain aspects, the inorganic fillers can be any suitable fillers, including, for example, aluminum oxide trihydrate (alumina), calcium carbonate, barium sulfate, or mixtures thereof. The fillers can comprise a virgin filler, a waste material, or even reclaimed fillers. Examples of recycled fillers include coal fly ash and calcium carbonate.

It is understood that the additives can comprise virgin and/or recycled materials. In some aspects, the recycled material can be present in any amount from 0 wt % to 100 wt %, including exemplary values of about 1 wt %, about 5 wt %, about 10 wt %, about 20 wt %, about 30 wt %, about 40 wt %, about 50 wt %, about 60 wt %, about 70 wt %, about 80 wt %, and about 90 wt %.

In certain aspects to increase the stability of the inventive artificial turf, the nonwoven backing layer can comprise grass seeds that allow the grass to grow through the installed product. In such aspects, the inventive artificial turf is a hybrid turf that comprises both a synthetic and natural grass.

In still further aspects, the nonwoven backing layer can further comprise any known in the art additives, coatings, or waste materials. In certain aspects, the nonwoven backing layer can also comprise an amount of infill materials commonly used in the turf. In such exemplary aspects, the reclaimed materials can comprise an amount of silica sand, rubber granules, organic components, dirt, any combination thereof, and the like.

In still further aspects, when more cushioning is required for the specific turf applications, the nonwoven backing layer can be a cushion backing layer. In some aspects, wherein the nonwoven backing layer is a cushion backing layer, the nonwoven backing layer exhibits a maximum compression set of about 25% as measured according to ASMT D1617 standard, including exemplary values of about 5%, about 10%, about 15%, and about 20%.

In certain aspects, the nonwoven backing layer can have a thickness between about 1/16 inch to about 2.5 inches, including exemplary values of about 1/8 inch, about 1/4 inch, about 1/2 inch, about 3/4 inch, about 1 inch, about 1.2 inch, about 1.5 inch, about 1.7 inch, about 2 inch, about 2.2 inch, and about 2.4 inch. It is understood that the nonwoven backing layer can have any thickness value between any foregoing values.

In yet other aspects, the nonwoven backing layer can have a density from about 3 lbs/ft$^3$ to about 30 lbs/ft$^3$, including exemplary values of about 4 lbs/ft$^3$, about 5 lbs/ft$^3$, about 6 lbs/ft$^3$, about 7 lbs/ft$^3$, about 8 lbs/ft$^3$, about 9 lbs/ft$^3$, about 10 lbs/ft$^3$, about 11 lbs/ft$^3$, about 12 lbs/ft$^3$, about 13 lbs/ft$^3$, about 14 lbs/ft$^3$, about 15 lbs/ft$^3$, about 16 lbs/ft$^3$, about 17 lbs/ft$^3$, about 18 lbs/ft$^3$, about 19 lbs/ft$^3$, about 20 lbs/ft$^3$, about 21 lbs/ft$^3$, about 22 lbs/ft$^3$, about 23 lbs/ft$^3$, about 24 lbs/ft$^3$, about 25 lbs/ft$^3$, about 26 lbs/ft$^3$, about 27 lbs/ft$^3$, about 28 lbs/ft$^3$, and about 29 lbs/ft$^3$. In still further aspects, the nonwoven backing layer can have any density value between any foregoing values. For example and without limitation, the nonwoven backing layer can have a density between 4 lbs/ft$^3$ to 7 lbs/ft$^3$, between 8 lbs/ft$^3$ to 10 lbs/ft$^3$, between 10 lbs/ft$^3$ to 17 lbs/ft$^3$, or between 18 lbs/ft$^3$ to 30 lbs/ft$^3$.

In still further aspects, the nonwoven backing layer can have a thickness from about 1/16 inch to about 2.5 inches and a density from about 3 lbs/ft$^3$ to about 30 lbs/ft$^3$.

In still further aspects, the nonwoven backing layer can be further capped with a mesh, scrim, or felt. The mesh, scrim, or felt can be optionally added to either the face side and/or the back side of the nonwoven backing layer. In still further aspects, the artificial turf can further comprise a secondary backing. In such aspects, the secondary backing can be attached to the nonwoven backing layer to either the face side and/or the back side of the nonwoven backing layer. In yet other aspects, the secondary backing can be attached by any methods known in the art, including, for example, through the coating, lamination, extrusion, and the like.

In certain aspects, the secondary backing can comprise various layers and coatings. Such exemplary backings can comprise extruded polymer sheets, laminated films, calendered hot melts and glues, latex, crosslinked polyurethanes, woven layer(s), meshes and scrims, or any combination thereof. In still further aspects, the secondary backing can comprise a film that can be laminated to the back side of the nonwoven backing layer to thermobond the turf fibers to themselves.

In some aspects, the disclosed nonwoven backings can be used for different applications. In certain aspects, the nonwoven backings can provide a 3D matrix that anchors grass blades (fibers). In some aspects, the disclosed nonwoven backings can be used on their own, even without the presence of the "artificial grass" fibers. In some aspects, the disclosed nonwoven backings can be used in hybrid turfs. In such aspects, natural grass can be grown within the nonwoven backings along with the artificial grass assembly. In still further aspects, the disclosed nonwoven backings can be used for soil stabilization and erosion control in various areas, for example, and without limitation for roadsides, slopes, mining areas, etc. In yet other aspects, the disclosed nonwoven backings can be used for landfill closure, preventing wind to "get under the tarp" and lifting or breaking it. In yet other aspects, the disclosed nonwoven backings can be used in agricultural applications using that as weed barrier, by allowing for the growth of the plant of interest only. In still other aspects, the nonwoven backings as disclosed herein can enhance playability and performance of the turf, by, for example, providing cushion, a drainage layer.

As disclosed herein, the artificial turf comprises a plurality of turf fibers. In certain aspects, the plurality of turf fibers are gravitationally laid on the face side of the nonwoven backing layer, and subsequently, needlepunched through the turf fibers to allow a more grass-like appearance. In such aspects, wherein the plurality of turf fibers are added to the nonwoven backing layer, the denim of the fibers present in the nonwoven backing layer can be from about 2 denier to about less than 20,000 denier including exemplary values of about 10 denier, about 50 denier, about 100 denier, about 200 denier, about 500 denier, about 800 denier, about 1,000 denier, about 1,500 denier, about 2,000 denier, about 2,500 denier, about 3,000 denier, about 3,500 denier, about 4,000 denier, about 4,500 denier, about 5,000 denier, about 5,500 denier, about 6,000 denier, about 6,500 denier, about 7,000 denier, about 7,500 denier, about 8,000 denier, about 8,500 denier, about 9,000 denier, about 9,500 denier, about 10,000 denier, about 10,500 denier, about 11,000 denier, about 11,500 denier, about 12,000 denier, about 12,500 denier, about 13,000 denier, about 13,500 denier, about 14,000 denier, about 14,500 denier, about 15,000 denier, about 15,500 denier, about 16,000 denier, about 16,500 denier, about 17,000 denier, about 17,500 denier, about 18,000 denier, about 18,500 denier, about 19,000 denier, about 19,500 denier, and less than 20,000 denier. In still further aspects, the fibers can have any denier value between any two foregoing denier values. It is understood that in some exemplary aspects, the grass fiber can be characterized as a multifilament bundle. In still other exemplary aspects, the grass fiber can be characterized as a single filament.

It is understood that the plurality of turf fibers can comprise any fibers known in the art and conventionally utilized in the artificial turfs. In yet other aspects, the plurality of turf fibers comprise tufted fibers. In still further aspects, the plurality of turf fibers comprise staple fibers. In still further aspects, the plurality of turf fibers are comprised of slit film fibers, monofilaments, or texturized fibers.

In yet other aspects, the plurality of turf fibers present in the inventive artificial turf can have any length predetermined by one of ordinary skill in the art and based on the specific application. In still further aspects, the plurality of turf fibers can have a length from about 0.25 inches to about 6 inches, including exemplary values of about 0.5 inches, about 0.75 inches, about 1 inch, about 1.25 inches, about 1.5 inches, about 1.75 inches, about 2 inches, about 2.25 inches, about 2.5 inches, about 2.75 inches, about 3 inches, about 3.25 inches, about 3.5 inches, about 3.75 inches, about 4 inches, about 4.25 inches, about 4.5 inches, about 4.75 inches, about 5 inches, about 5.25 inches, about 5.5 inches, and about 5.75 inches. It is understood that the plurality of turf fibers can have any length value between any two foregoing values.

In still further aspects, the plurality of turf fibers present in the inventive artificial turf can have any denier predetermined by one of ordinary skill in the art and based on the specific application. In some aspects, the plurality of turf fibers can have a denier value from about 3 denier to about 20,000 denier, including exemplary values of about 5 denier, about 10 denier, about 20 denier, about 30 denier, about 40 denier, about 50 denier, about 60 denier, about 70 denier, about 80 denier, about 90 denier, about 100 denier, about 200 denier, about 300 denier, about 400 denier, about 500 denier, about 600 denier, about 700 denier, about 800 denier, about 900 denier, about 1,000 denier, about 1,500 denier, about 2,000 denier, about 2,500 denier, about 3,000 denier, about 3,500 denier, about 4,000 denier, about 4,500 denier, about 5,000 denier, about 5,500 denier, about 6,000 denier, about 6,500 denier, about 7,000 denier, about 7,500 denier, about 8,000 denier, about 8,500 denier, about 9,000 denier, about 9,500 denier, about 10,000 denier, about 10,500 denier, about 11,000 denier, about 11,500 denier, about 12,000 denier, about 12,500 denier, about 13,000 denier, about 13,500 denier, about 14,000 denier, about 14,500 denier, about 15,000 denier, about 15,500 denier, about 16,000 denier, about 16,500 denier, about 17,000 denier, about 17,500 denier, about 18,000 denier, about 18,500 denier, about 19,000 denier, about 19,500 denier, and less than 20,000 denier. In still further aspects, the fibers can have any denier value between any two foregoing denier values. For example and without limitation, in aspects where the slit film fibers are present, the fiber denier is from about 100 denier to about 15,000 denier. In yet other exemplary aspects, where the monofilament fibers are present, the fiber denier is from about 3 denier to about 3,000 denier. In certain exemplary aspects, the small denier fibers from about 3 denier to about 500 denier can act as binding fibers, to add cushion, or to provide support along the base of the slit film fibers to assist them in standing rather than laying over onto the nonwoven backing layer.

The plurality of turf fibers can comprise any material that is conventionally used in the artificial turf manufacturing, singly or in a combination with other such materials. For example, and without limitation, the plurality of turf fibers can be synthetic, such as, for example, a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polybutylene terephthalate (PBT), polytrimethylene terephthalate (PTT), or any combination thereof. In still further aspects, the plurality of turf fibers can comprise polymeric fibers comprising at least one of nylon, polyester, polyethylene, and polypropylene. In some exemplary aspects, the plurality of turf fibers can comprise one or more of the biodegradable materials, including, for example, and without limitation, polylactic acid (PLA). In still further aspects, the plurality of turf fibers can comprise a combination of any of the materials mentioned above.

In still further aspects, the artificial turf described herein comprises, a portion of the back side turf fibers bonded to themselves an adhesive coating. In such aspects, the adhesive coating can be any adhesive coating known in the art. In certain aspects, the adhesive coating can comprise various polyolefin materials such as, for example and without limitation, ethylene acrylic acid (EAA), ethylene vinyl acetate (EVA), polypropylene or polyethylene (e.g., low density polyethylene (LDPE), linear low density polyethylene (LLDPE) or substantially linear ethylene polymer, or mixtures thereof). In some aspects, the adhesive coating can comprise latex. It is further contemplated that the adhesive coating can be selected from a group comprising, without limitation, an EVA hotmelt, a vinyl acetate ethylene (VAE) emulsion, carboxylated styrene-butadiene (XSB) latex copolymer, a styrene-butadiene resin (SBR) latex, a BDMMA latex, an acrylic latex, an acrylic copolymer, a styrene copolymer, butadiene acrylate copolymer, a polyolefin hotmelt, polyurethane and/or emulsions, and any combination thereof. In still further aspects, the precoat composition comprises latex. In yet other aspects, where the adhesive coating comprises the latex composition, the latex further comprises a carboxylated styrene-butadiene (XSB) latex copolymer, a styrene-butadiene resin (SBR) latex, a BDMMA latex, an acrylic latex, an acrylic copolymer, a styrene copolymer, or a combination thereof.

In still further aspects, the artificial turf, described herein, comprises the portion of the back side turf fibers bonded to themselves by mechanical bonding. In still further aspects, the artificial turf, described herein, comprises the portion of the back side turf fibers bonded to themselves by thermobonding.

In still further aspects, a portion of the back side portion of turf fibers is also bonded to the back side of the nonwoven backing layer. In still further aspects, the plurality of turf fibers and the nonwoven backing are each comprised of the same polymeric material. In still further aspects, the plurality of turf fibers and the nonwoven backing layer are each comprised of the different polymeric material.

The inventive artificial turf can optionally comprise a primary backing disposed between the plurality of turf fibers and the nonwoven backing layer.

In aspects where the primary backing is present, the primary backing comprises a polyolefin, a polyester, a polyamide, or a combination thereof. In such aspects, the primary backing can be woven and non-woven. In certain aspects, the primary backing can comprise non-woven webs, or spunbonded materials. In some aspects, the primary backing can comprise a combination of woven and non-woven materials. In some aspects, the primary backing comprises a polyolefin polymer. In other aspects, the polyolefin polymer comprises polypropylene. In yet other aspects, the primary backing is a slit film polypropylene sheet, such as that sold by Propex or Synthetic Industries owned by Shaw Industries. In yet further aspects, the primary backing can comprise polyester. In a still further aspect, the primary backing can comprise polyamide. In yet further aspects, the primary backing can comprise a combination of polyamide and polyester. In certain aspects, the polyamide is nylon. In some other aspects, the primary backing can comprise a woven polyethylene terephthalate (PET). In yet other aspects, the primary backing can comprise a woven PET having a post-consumer and/or a post-industrial content.

In certain aspects, the primary backing is a spun-bond primary backing. In some aspect, the spun-bond primary backing component can comprise a bi-component filament of a sheath-core type. In some aspects, the polymeric core component can have a higher melting point than the polymeric sheath component. In some aspects, the polymeric core component can comprise polyester, aliphatic polyamides, polyphenylene oxide and/or co-polymers or blends thereof. In yet other aspects, the polyester can comprise polyethylene terephthalate, polybutylene terephthalate, or polyparaphenylene terephthalamide. In yet other aspects, the polymeric core comprises polyethylene terephthalate. In further aspects, the sheath polymer can comprise a polyamide, polyethylene, or polyester. In yet further aspects, the sheath polymer comprises nylon. In still further aspects, the sheath-core primary backing component comprises polyester as a core component and nylon as a sheath component. The exemplary sheath-core primary backing is commercially available from Bonar. In yet other aspects, an exemplary polyester non-woven primary backing is commercially available from Freudenberg. In still further aspects, such a primary backing provides extra stability to the product.

In still further aspects, the inventive artificial turf disclosed herein is permeable to moisture. In still further aspects, the artificial turf is fully recyclable.

In yet further aspects, the inventive artificial turf can be provided in any form known in the art. In some aspects, the inventive artificial turf can be provided in a form of panels. In such aspects, the panels can be installed in any selected orientation. In still further aspects, the inventive artificial turf has a continuous length and is rolled into a roll. In such aspects, the roll can be unrolled on the installation site. In still further aspects, the inventive artificial turf can have any utility. In certain aspects, it can be used as a cushion, a single-use event turf, a temporary ground cover in construction zones, wind control system for environmental and civil industries, a dust control system, a drainage control system, a filter control system, an erosion control system, a land stabilization system, or in some exemplary aspects, a roof stabilization system.

Figure 2:
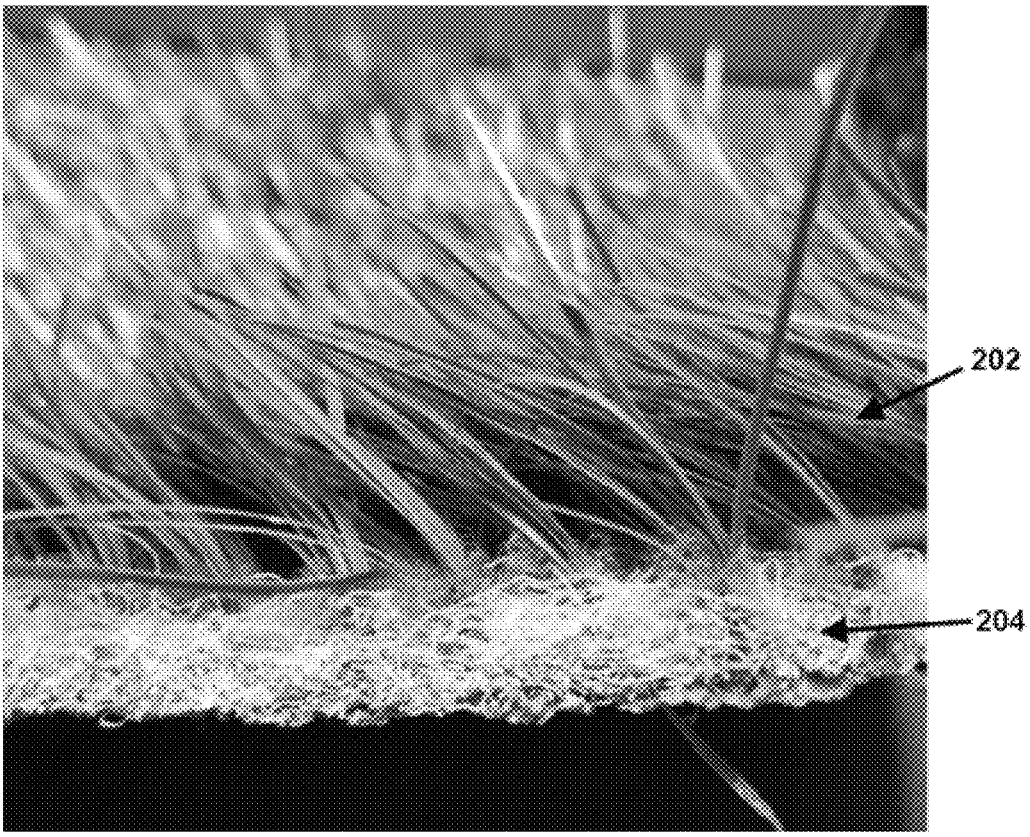
FIG. 2 depicts a side view photograph of an exemplary artificial turf according to aspects of the present invention.
Figure 3:
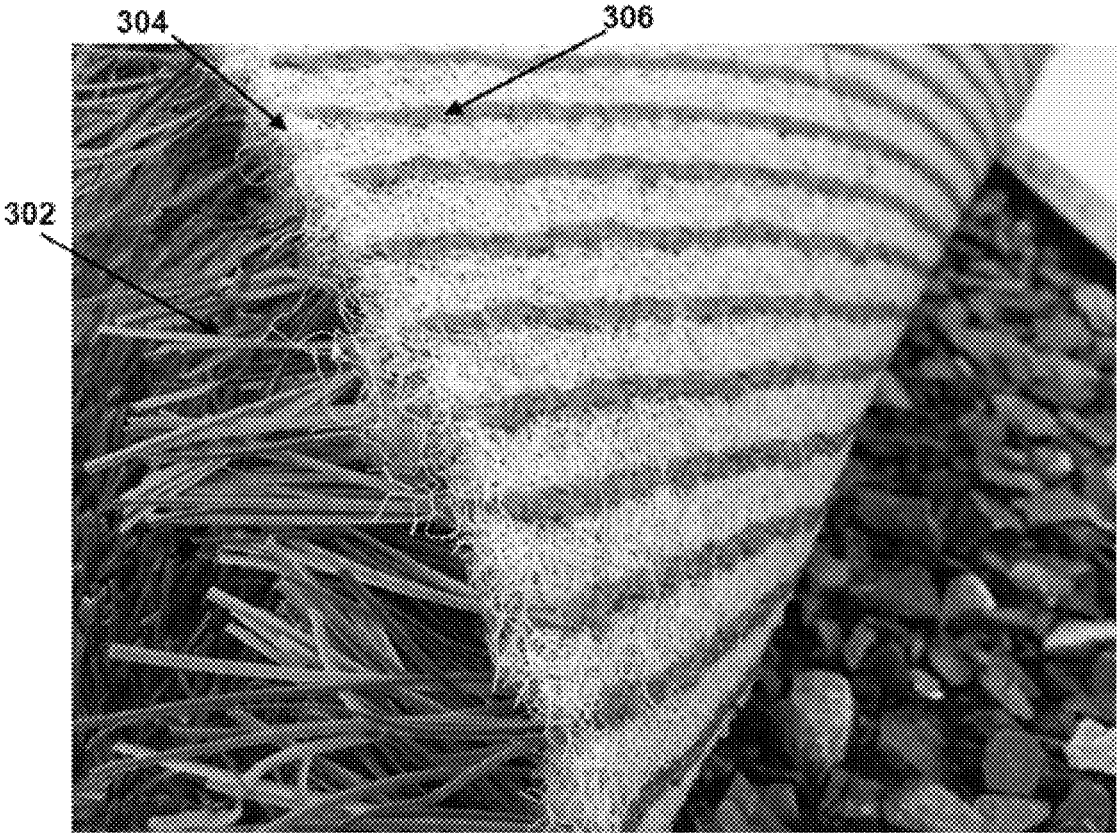
FIG. 3 depicts a photograph showing a back side of the nonwoven backing layer and turf fibers of an exemplary artificial turf according to aspects of the present invention.

An exemplary inventive artificial turf is depicted on FIG. 2. It can be seen that the turf fibers 202 are inserted into the nonwoven backing layer 204. FIG. 3 shows both the turf fibers 302 and the back side of the nonwoven backing layer 304, wherein the back side portion 306 of the turf fibers are bonded to themselves by thermobonding.

Methods

The present disclosure further provides a method for manufacturing an artificial turf, comprising: inserting a plurality of turf fibers into a nonwoven backing layer having a face side and a back side such that the plurality of turf fibers extend through the nonwoven backing layer and a face side portion of the turf fibers extends from the face side of the nonwoven backing layer and a back side portion of the turf fibers extends from the back side of the backing layer; and bonding at least a portion of the back side portion of turf fibers to themselves.

In still further aspects, the nonwoven backing layer is a fiber batt comprised of the gravitationally laid fibers. In certain aspects, the gravitationally laying process can be done by utilizing a card and cross lapping system, an airlay system, or a combination thereof. In still further aspects, it can be done by calendering. In still further aspects, after the fibers are gravitationally laid, the fibers are mechanically bonded. In other aspects, after the fibers are gravitationally laid, the fibers are thermally bonded. Any methods of the mechanical and thermal bonding can be utilized to bond the gravitationally laid fibers of the nonwoven backing layer. In still further aspects, the nonwoven backing layer is needlepunched. In yet other aspects, the nonwoven backing can be further heat and pressure treated to form the nonwoven backing having a predetermined density.

It is understood that the nonwoven backing layer prepared by the disclosed methods can be comprised of any fibers described herein. In some aspects, the nonwoven backing layer can comprise at least one of nylon, polyester, polyethylene, and polypropylene, cotton, Kenaf, jute, or any combination thereof.

In yet other aspects, the nonwoven backing layer prepared by the disclosed methods can comprise fibers having any length or denier described in details above.

In still further aspects, the nonwoven backing layer can have at least one additive material distributed within the nonwoven backing layer. The distribution of the additive materials can be done by any methods known in the art and at any step of making the inventive artificial turf. At least one additive material distributed within the nonwoven backing layer can comprise any of the materials described in details above. In some exemplary aspects, at least one additive material comprises at least one of rubber crumbs, wood chips, sand, grass seeds, and inorganic fillers.

In still further aspects, the nonwoven backing layer can be formed into the cushion. It is understood that the nonwoven backing layers can have any thickness and density described in details above.

In yet other aspects, the plurality of turf fibers present in the inventive artificial turf can be inserted into the nonwoven backing by a process that comprises gravitationally laying the turf fibers on the face side of the nonwoven backing and needlepunching the gravitationally laid turf fibers into the nonwoven backing. Similarly, the process of gravitationally laying the turf fibers can comprise a card and cross-lapping system, an airlay system, or a combination thereof.

In some aspects, the plurality of turf fibers can be inserted into the nonwoven backing layer by tufting. Any conventional tufting apparatus can be used to insert the plurality of turf fibers into the nonwoven backing layer. In some aspects, to improve the tufting process, longer spikes on the spike-roller to grab the nonwoven fully can be utilized. In yet other aspects, a "carrier" fabric, mesh, or layer can be provided to the nonwoven backing layer to facilitate pulling it through the process.

In yet other aspects, the plurality of turf fibers can comprise any plurality of turf fibers described herein. In some aspects, the plurality of turf fibers are comprised of the staple fibers. In yet other aspects, the plurality of turf fibers comprised of the slit film fibers. The plurality of turf fibers can have any length and denier described in details above.

In still further aspects, the plurality of turf fibers can comprise any material described in details above. In certain exemplary aspects, the plurality of turf fibers can comprise polymeric fibers comprising at least one of nylon, polyester, polyethylene, and polypropylene. It is further understood that the plurality of turf fibers and the nonwoven backing layer are each can be comprised of the same polymeric material. In yet other aspects, the plurality of turf fibers and the nonwoven backing layer are each can be comprised of the different polymeric materials.

In still further aspects, the step of bonding at least a portion of the back side portion of turf fibers to themselves comprises applying an adhesive coating. It is understood that any adhesive material described herein can be applied. It is further understood that any known in the art methods of applying the adhesive material can be utilized. In some exemplary aspects, the adhesive material can be applied by spray, by powder scattering, as a hot melt, by extrusion, lamination, and the like.

In still further aspects, the step of bonding at least a portion of the back side portion of turf fibers to themselves comprises a mechanical bonding. In exemplary aspects, the mechanical bonding is provided by needlepunching. In yet other aspects, the mechanical bonding can comprise a source of high-pressure air and/or water. In these aspects, the source of high-pressure air and/or water can provide jets of air and/or water having sufficient energy to move filaments from the turf fibers so as to have stray filaments pushed into adjacent filaments to make fibrous mechanical connections. In further aspects, the mechanical bonding can comprise threads that can be sewn into the edges to secure the turf fibers/filaments. In even further aspects, the mechanical bonding can comprise ultrasonic pins to secure the edge turf fibers/filaments. In other aspects, the mechanical bonding can comprise mechanical combing of the turf fibers/filaments. In other aspects, mechanical bonding can comprise vacuum combing behind the edge turf fibers/filaments. In further aspects, the mechanical bonding can comprise hot air jets. In these aspects, the hot air jets can be used to move and fuse the edge turf fibers/filaments.

In yet other aspects, the step of bonding at least a portion of the back side portion of turf fibers to themselves comprises a thermobonding. In some exemplary aspects, the thermobonding can comprise a heated rod and/or a heated shoe. In these aspects, the heated rod and/or heated shoe can be used to heat fuse the edge turf fibers/filaments.

In some exemplary aspects, lamination can be utilized to thermobond the fibers to themselves. In certain aspects, a film having a thickness of about 1 mil to about 10 mil, including exemplary values of about 2 mil, about 3 mil, bout 4 mil, about 5 mil, about 6 mil, about 7 mil, about 8 mil, and about 9 mil, can be laminated to the back surface of the nonwoven backing layer to thermobond the turf fibers to themselves. In certain aspects, the inventive artificial turf can be fed through a film laminator without adding any additional films to ensure the thermobonding of the fibers to themselves. In still further aspects, the method described herein further comprises bonding at least a portion of the back side portion of turf fibers to the back side of the nonwoven backing layer.

In still further aspects, the artificial turf prepared by methods disclosed herein is permeable to moisture.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary and are not intended to limit the disclosure. Efforts have been made to ensure accuracy with respect to numbers (e.g., amounts, temperature, etc.), but some errors and deviations should be accounted for. Unless indicated otherwise, parts are parts by weight, temperature is in ° F. or is at ambient temperature, and pressure is at or near atmospheric.

Figure 4:
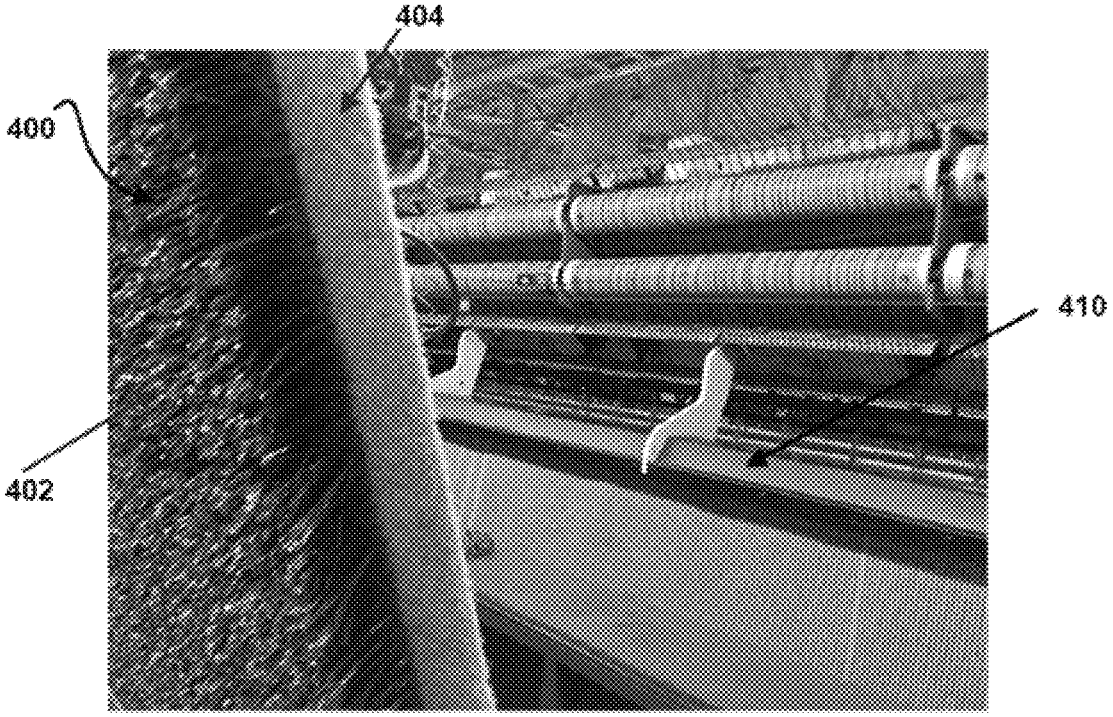
FIG. 4 depicts a photograph of an exemplary artificial turf without woven primary backing according to aspects of the present invention.

Samples have been prepared to evaluate technical capabilities for tufting into an exemplary nonwoven backing layer as described herein. Width of the nonwoven material was 150¾ inch at unwind, 149⅜ inch at the tufting bar, and 149½ inch at mending. Needle penetration, needle travel and clearance, tufting speed, and integrity of tufting bar have been evaluated. No undesirable behavior was observed for the needle penetration and travel, and integrity of the tufting bar throughout the process at a maximum tufting speed of 302 RPMs. An exemplary tufted artificial turf is shown on FIG. 4. As can be seen in FIG. 4, the tufting machine 410 can produce an artificial turf 400 having a plurality of turf fibers 402 tufted directly into the nonwoven backing layer 404 without the use of the conventional woven primary backing material.

Figure 5:
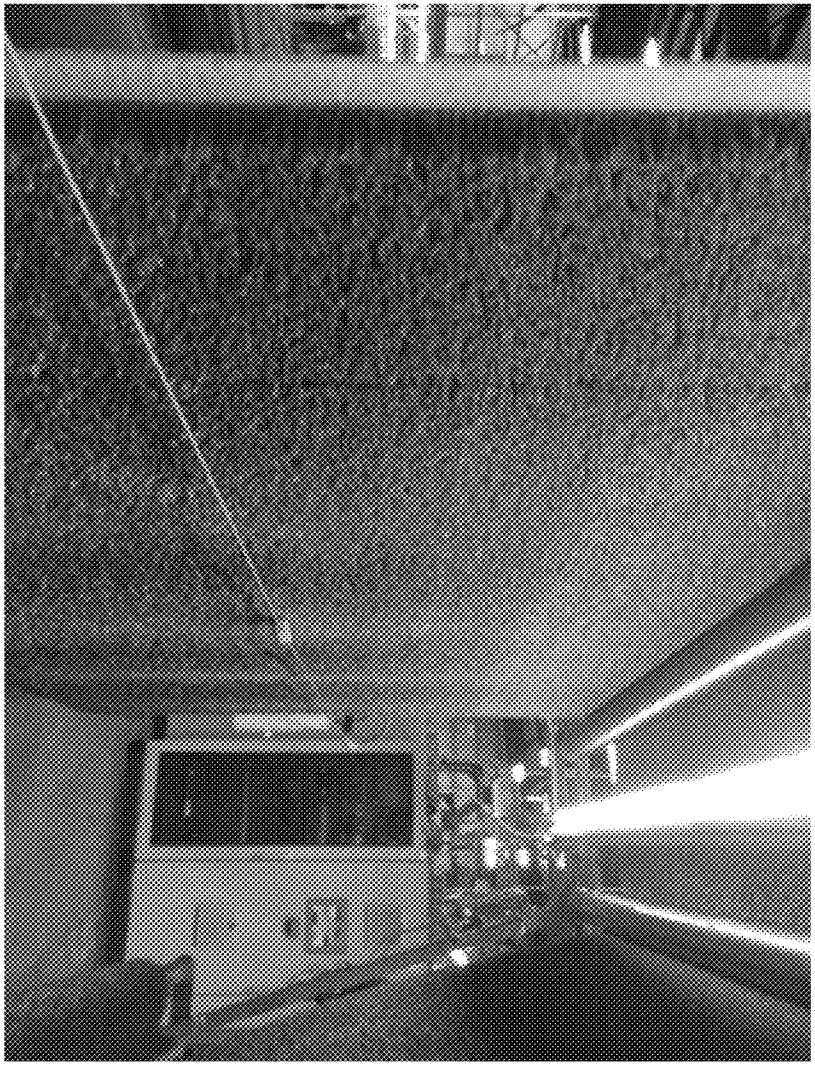
FIG. 5 shows a photograph showing a face appearance of an exemplary artificial turf without woven primary backing according to aspects of the present invention.
Figure 6:
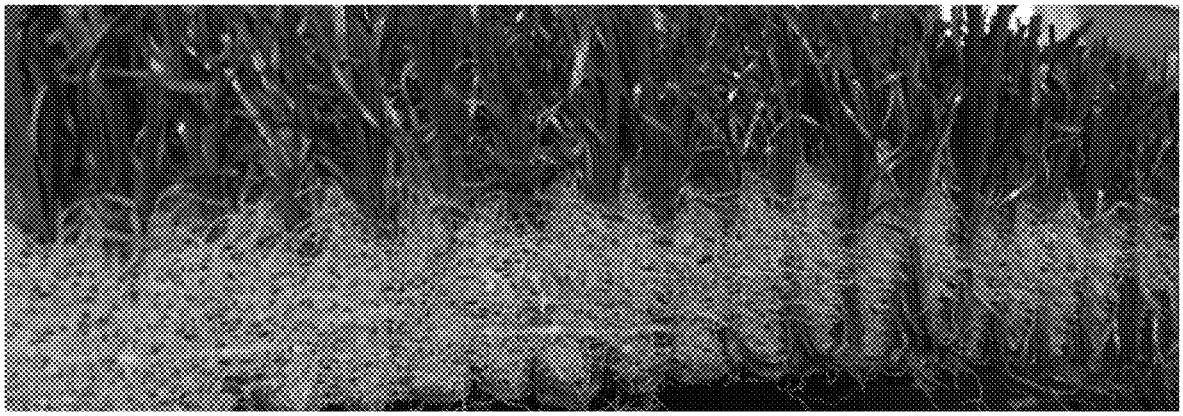
FIG. 6 depicts a side view photograph of an exemplary artificial turf according to aspects of the present invention.
Figure 7:
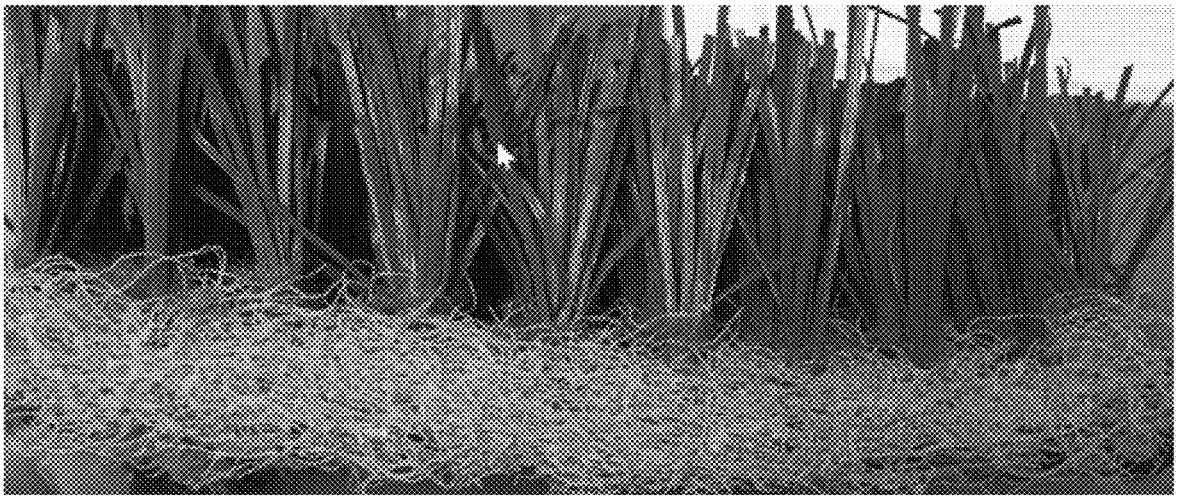
FIG. 7 depicts a side view photograph of an exemplary artificial turf according to aspects of the present invention.
Figure 8:
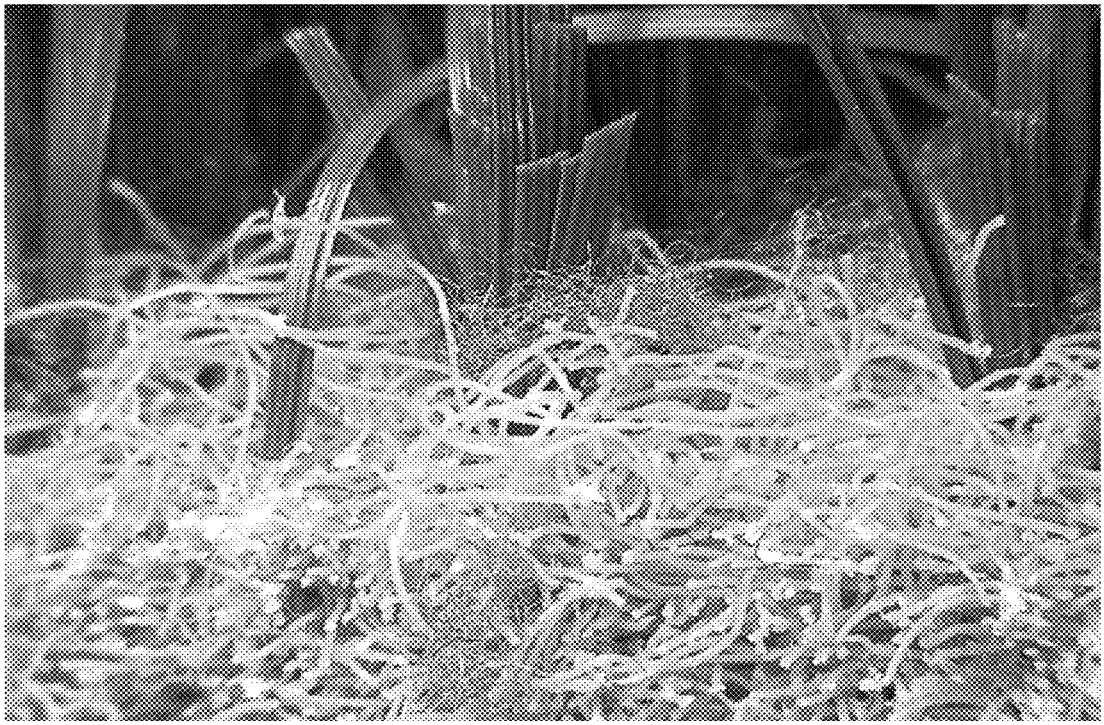
FIG. 8 depicts a side view photograph of an exemplary artificial turf according to aspects of the present invention.
Figure 9:
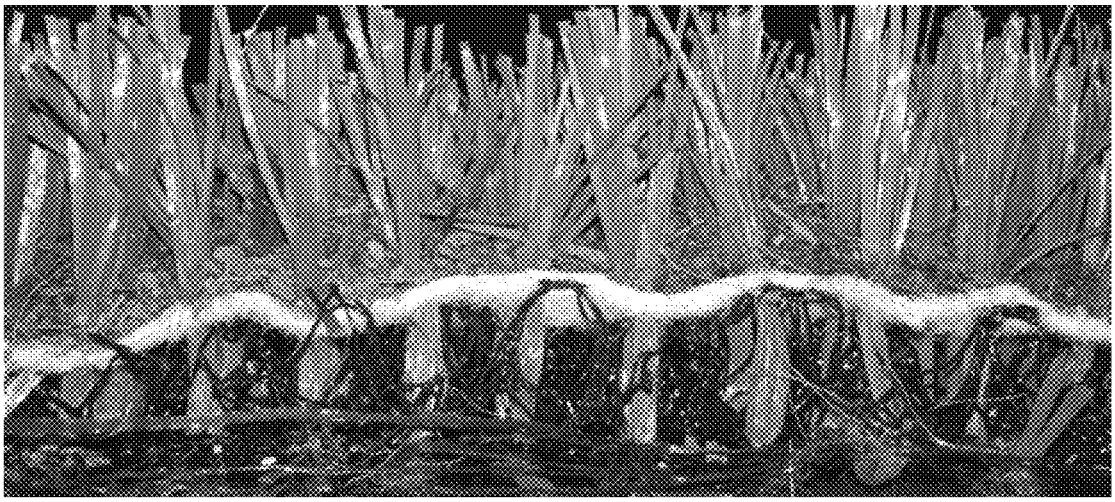
FIG. 9 depicts a side view photograph of an exemplary artificial turf according to aspects of the present invention.
Figure 10:
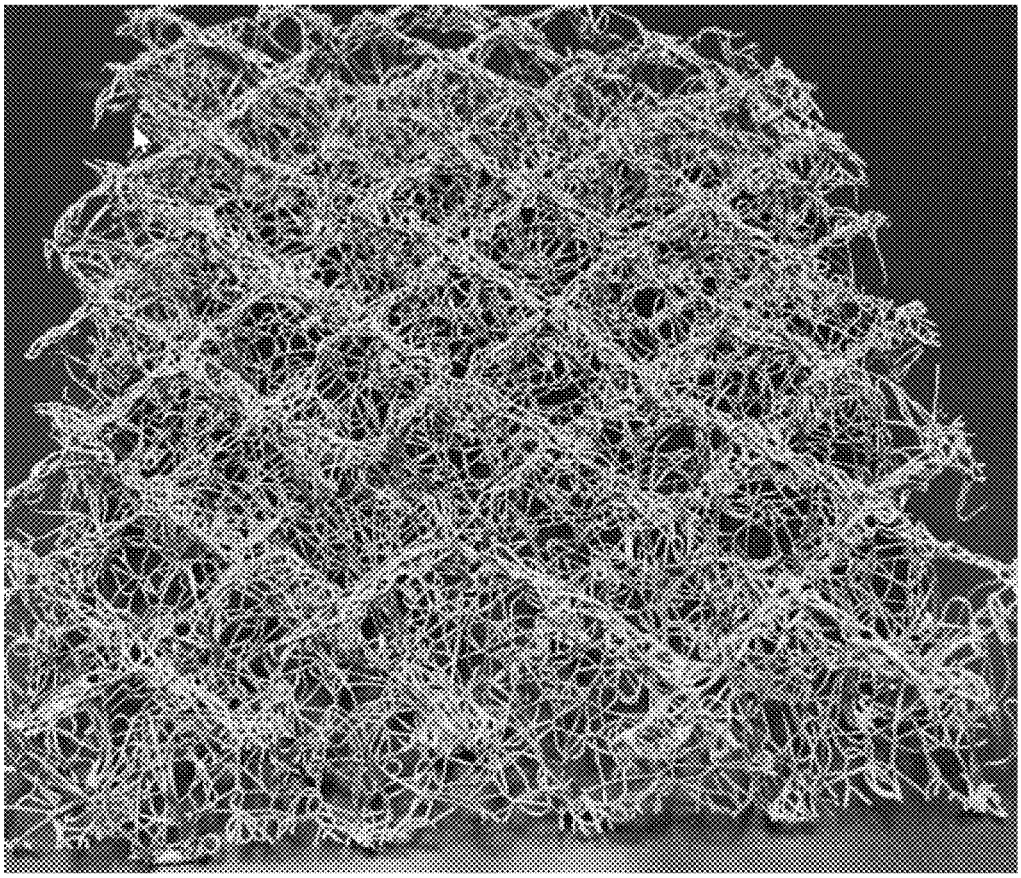
FIG. 10 depicts a photograph of an exemplary metal mesh used as a backing layer.
Figure 11:
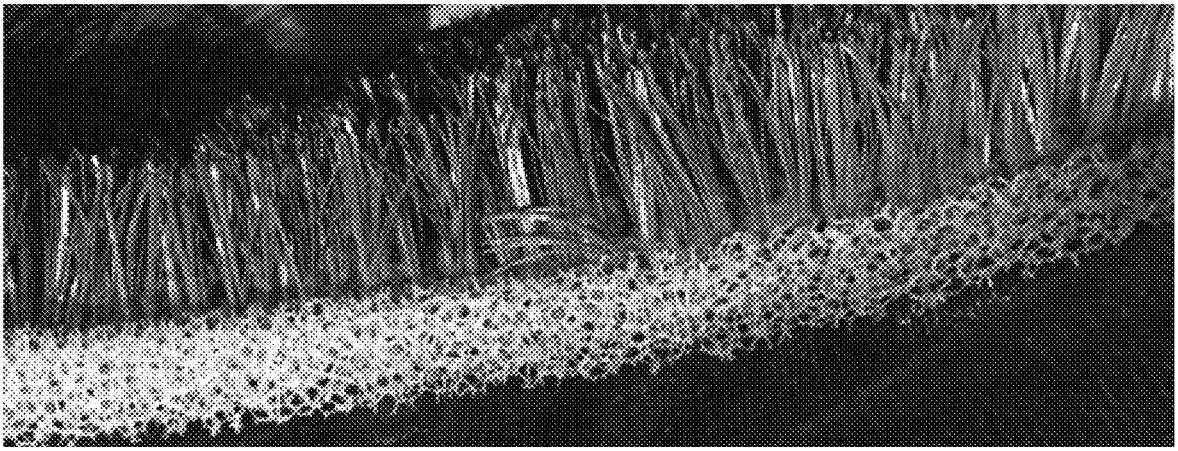
FIG. 11 depicts a side view photograph of an exemplary artificial turf according to aspects of the present invention.
Figure 12:
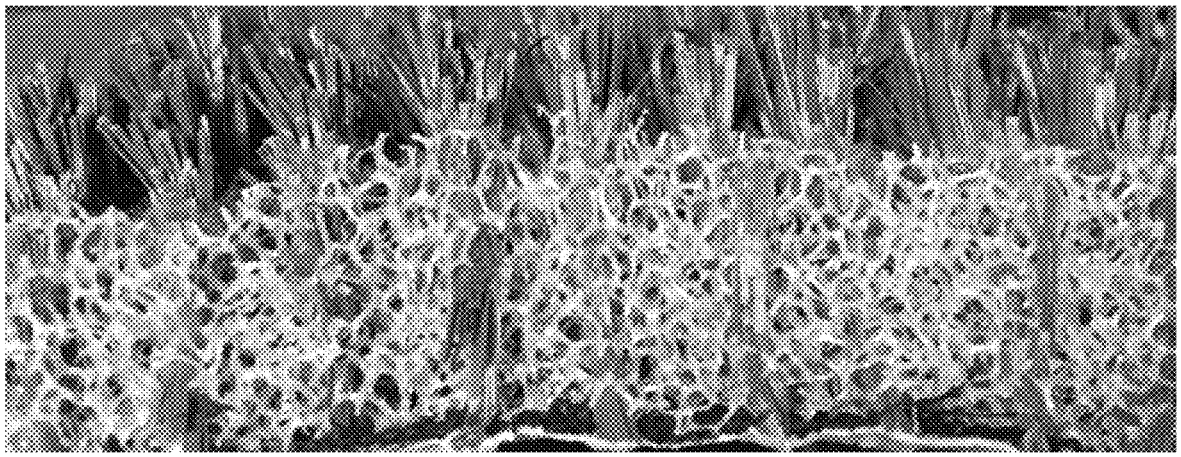
FIG. 12 depicts a side view photograph of an exemplary artificial turf according to aspects of the present invention.
Figure 13:
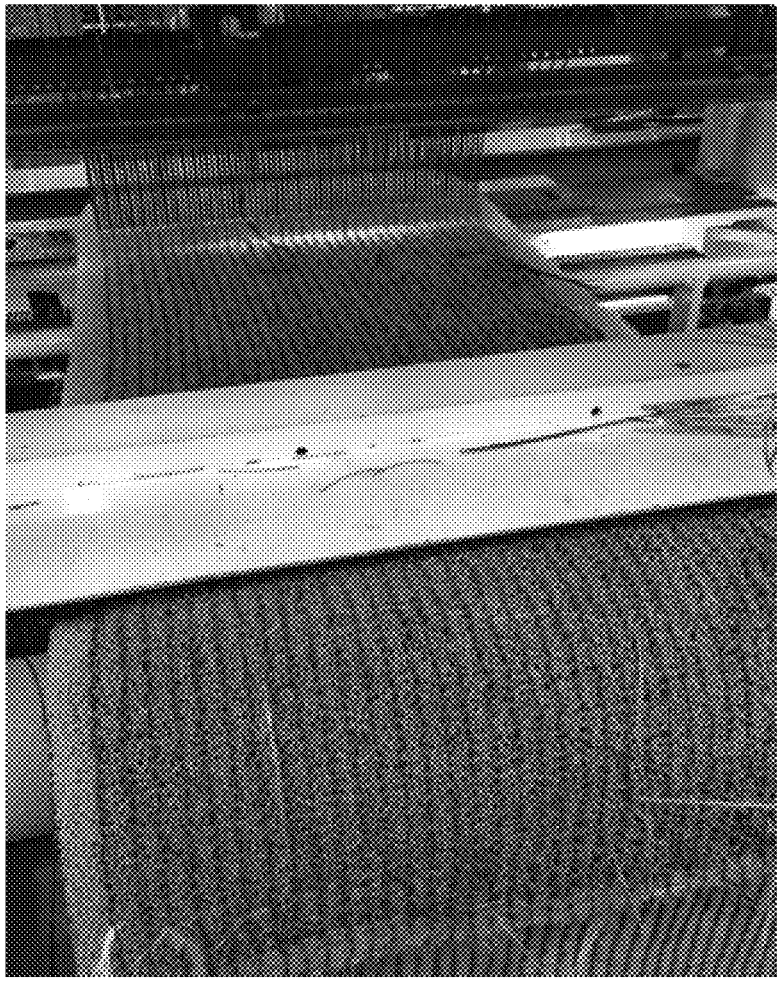
FIG. 13 depicts a photograph showing a back side of a foam backing layer and turf fibers of an exemplary artificial turf according to aspects of the present invention.

It was found that the woven primary backing is not required and can be used as an optional layer. In some examples, it was found that a dissimilar tension that can be present between the woven and nonwoven backing can result in undesirable wrinkles. It was also shown that the pile height loss of the inventive artificial turf that does not comprise a primary backing, due to a thickness of the nonwoven backing layer, was about 6/32 inch. FIG. 5 shows an exemplary inventive artificial turf formed by the methods disclosed herein with an exceptional face pile appearance.

While certain exemplary aspects of the invention have been described and disclosed, it will be apparent to those skilled in the art that various changes and modifications may be made that will achieve some or even all of the advantages of the invention without departing from the spirit and scope of the invention.

What is claimed is:

1. An artificial turf, consisting of:

a homogeneous nonwoven backing layer having a face side and a back side, wherein the homogeneous nonwoven backing layer comprises low-melt fibers having a melting point from about 100° C. to about 180° C. and high-melt fibers having a higher melting point than the low-melt fibers; and a plurality of turf fibers extending through the homogeneous nonwoven backing layer such that a face side portion of the plurality of turf fibers extends from the face side of the homogeneous nonwoven backing layer and a back side portion of the plurality of turf fibers extends from the back side of the homogeneous nonwoven backing layer, wherein at least a portion of the back side portion of turf fibers are bonded to themselves, wherein the plurality of turf fibers consists of only one type of a single polymer fiber being selected from the group consisting of nylon, polyester, polypropylene (PP), polyethylene (PE), polyurethane (PU), polyvinyl chloride (PVC), polyethylene terephthalate (PET), polypropylene terephthalate PPT), polybutylene terephthalate (PBT), and polytrimethylene terephthalate (PTT), wherein melted low-melt fibers in the homogeneous nonwoven backing layer form globules of the melted low-melt fibers at crossover points where low-melt fibers and high-melt fibers-intersect.

2. The artificial turf of claim 1, wherein the homogeneous nonwoven backing layer comprises a fiber batt.

3. The artificial turf of claim 2, wherein the fiber batt comprises fibers that are mechanically bonded.

4. The artificial turf of claim 2, wherein the fiber batt comprises fibers that are thermally bonded.

5. The artificial turf of claim 1, wherein the homogeneous nonwoven backing layer is needlepunched.

6. The artificial turf of claim 1, wherein the low-melt fibers and the high-melt fibers are individually selected from the group consisting of nylon, polyester, polyethylene, polypropylene, cotton, Kenaf, and jute, or any combination thereof.

7. The artificial turf of claim 1, wherein the low-melt fibers and the high-melt fibers individually have a length from about 1 to 8 inches and a denier ranging between about 2 DPF to less than about 20,000 DPF.

8. The artificial turf of claim 1, wherein the homogeneous nonwoven backing comprises at least one additive material distributed therein, and wherein the at least one additive material comprises at least one of rubber crumbs, wood chips, sand, grass seeds, foam chips, and an inorganic filler.

9. The artificial turf of claim 1, wherein the homogeneous nonwoven backing layer is a cushion backing layer having a thickness between about 1/16 inch to about 2.5 inches, and wherein the homogeneous nonwoven backing layer is needlepunched.

10. The artificial turf of claim 1, wherein the plurality of turf fibers are gravitationally laid and needlepunched.

11. The artificial turf of claim 1, wherein the plurality of turf fibers are tufted fibers.

12. The artificial turf of claim 1, wherein the plurality of turf fibers are comprised of staple fibers.

13. The artificial turf of claim 1, wherein the plurality of turf fibers are comprised of slit film fibers, monofilaments, or texturized fibers.

14. The artificial turf of claim 1, wherein the plurality of turf fibers have a length from 0.25 inches to about 6 inches.

15. The artificial turf of claim 14, wherein the plurality of turf fibers have a denier from about 100 DPF to about 20,000 DPF.

16. The artificial turf of claim 1, wherein a portion of the back side portion of turf fibers is bonded to the back side of the homogeneous nonwoven backing layer.

17. The artificial turf of claim 1, wherein the homogeneous nonwoven backing layer and the plurality of turf fibers are each comprised of the same polymeric material.

18. The artificial turf of claim 1, wherein the turf is permeable to moisture.

* * * * *